US011489316B2

(12) United States Patent
Ma et al.

(10) Patent No.: US 11,489,316 B2
(45) Date of Patent: Nov. 1, 2022

(54) SPARK PLUG SHELL AND METHOD OF MANUFACTURE

(71) Applicant: Federal-Mogul Ignition LLC, Southfield, MI (US)

(72) Inventors: Shuwei Ma, Ann Arbor, MI (US); Richard Keller, Whitehouse, OH (US)

(73) Assignee: FEDERAL-MOGUL IGNITION LLC, Southfield, MI (US)

( * ) Notice: Subject to any disclaimer, the term of this patent is extended or adjusted under 35 U.S.C. 154(b) by 0 days.

(21) Appl. No.: 17/441,968

(22) PCT Filed: Apr. 9, 2020

(86) PCT No.: PCT/US2020/027508
§ 371 (c)(1),
(2) Date: Sep. 22, 2021

(87) PCT Pub. No.: WO2020/210519
PCT Pub. Date: Oct. 15, 2020

(65) Prior Publication Data

US 2022/0166195 A1 May 26, 2022

Related U.S. Application Data

(60) Provisional application No. 62/832,557, filed on Apr. 11, 2019.

(51) Int. Cl.
*H01T 13/06* (2006.01)
*H01T 21/02* (2006.01)

(52) U.S. Cl.
CPC ..... *H01T 13/06* (2013.01); *H01T 21/02* (2013.01)

(58) Field of Classification Search
CPC ..... H01T 13/02; H01T 13/06; H01T 13/39
(Continued)

(56) References Cited

U.S. PATENT DOCUMENTS 4,233,065 A 11/1980 Koul
4,440,568 A 4/1984 Staggers et al.
(Continued)

FOREIGN PATENT DOCUMENTS

CN 101779350 A 7/2010
CN 104471089 A 3/2015
(Continued)

OTHER PUBLICATIONS

International Preliminary Report on Patentability issued for PCT/US2020/027508 dated Oct. 21, 2021; 8 pages.
(Continued)

*Primary Examiner* — Christopher M Raabe
(74) *Attorney, Agent, or Firm* — Reising Ethington, P.C.

(57) ABSTRACT

A metal shell for a spark plug is made from a steel material that has increased carbon content and, in some embodiments, boron as well. The steel material is well-suited for extrusion because of its ductility, while maintaining requisite strength. The spark plug shell may have a reduced outer diameter ($OD_{HL}$) at a crimped hot lock region, such as the case when the shell is used in smaller diameter spark plugs, such as M8 and M10 plugs. According to a non-limiting example, the spark plug shell steel material comprises 0.20-0.55 wt % carbon, inclusive.

15 Claims, 3 Drawing Sheets

(58) Field of Classification Search
USPC ..... 313/143
See application file for complete search history.

(56) References Cited

U.S. PATENT DOCUMENTS

| | | | |
|---|---|---|---|
| 5,852,280 | A | 12/1998 | Mizuno |
| 6,373,173 | B1 | 4/2002 | Suzuki |
| 6,741,015 | B2 | 5/2004 | Suzuki et al. |
| 6,809,463 | B2 | 10/2004 | Suzuki |
| 7,866,294 | B2 | 1/2011 | Lykowski et al. |
| 10,063,036 | B2 | 8/2018 | Kozakai et al. |
| 2002/0041137 | A1 | 4/2002 | Nishikawa et al. |
| 2003/0168955 | A1* | 9/2003 | Suzuki ..... H01T 21/02 313/143 |
| 2007/0046162 | A1 | 3/2007 | Moribe et al. |
| 2007/0210688 | A1 | 9/2007 | Suzuki et al. |
| 2010/0175654 | A1 | 7/2010 | Lykowski et al. |
| 2011/0043093 | A1 | 2/2011 | Nunome |
| 2011/0121712 | A1 | 5/2011 | Ma |
| 2016/0060721 | A1 | 3/2016 | Nagao et al. |
| 2017/0033538 | A1 | 2/2017 | Kobayashi et al. |
| 2017/0077681 | A1 | 3/2017 | Kozakai et al. |

FOREIGN PATENT DOCUMENTS

| | | | | |
|---|---|---|---|---|
| CN | 106911081 | A | | 6/2017 |
| IN | 330948 | | | 1/2020 |
| JP | 2003257584 | A | | 9/2003 |
| JP | 2006233269 | A | * | 9/2006 |
| JP | 2018044235 | A | * | 3/2018 |

OTHER PUBLICATIONS

International Search Report and Written Opinion issued for PCT/US2020/027508 dated Jul. 30, 2020; 11 pages.
Office action issued by the National Intellectual Property Administration (CNIPA) for 202080027166.6 dated Feb. 11, 2022; 8 pages.
Office action issued by the China National Intellectual Property Administration (CNIPA) for application No. CN 202080027166.6 dated Aug. 25, 2022; 11 pages.

* cited by examiner

SPARK PLUG SHELL AND METHOD OF MANUFACTURE

RELATED APPLICATIONS

This application claims the priority of U.S. provisional application No. 62/832,557, filed Apr. 11, 2019, the entire contents of which is hereby incorporated by reference.

FIELD

This invention generally relates to spark plugs, and more particularly, to metal shells for spark plugs.

BACKGROUND

Low carbon steels (e.g., C1005, C1008, and C1010 steels) have been traditionally used as materials for extruded spark plug shells. These materials have lower strength and higher ductility, making them more suitable for deep extrusion. Typically, these low carbon steels are widely used for M12 spark plugs (shell outer diameter of 12 mm or 0.485 inches), as well as larger sized plugs.

With engine downsizing requirements, spark plugs are correspondingly downsizing, with sizes such as M8 and M10 being used more frequently. With this size decrease, there is also a trend of using a thicker ceramic insulator to increase the voltage capability of the spark plugs. This requires the use of thinner but stronger shell materials. To satisfy these requirements, higher strength steel materials for the shell are required. However, higher strength steel can oftentimes be more difficult to manufacture, in processes such as extrusion, to cite one example.

SUMMARY

According to one example, there is provided a spark plug shell, comprising: a tubular body of steel material, the tubular body having an axial bore with a longitudinal axis ($L_{Shell}$), wherein the steel material comprises 0.20-0.55 wt % carbon, inclusive, and includes a grain structure with a plurality of grains, each of the plurality of grains in the grain structure includes a longitudinal axis ($L_G$) along a longest extent of the grain and, for a majority of the plurality of grains in the grain structure, the longitudinal axis ($L_G$) of the grain is aligned with the longitudinal axis ($L_{Shell}$) of the axial bore of the shell.

According to various embodiments, the spark plug shell may further include any one of the following features or any technically-feasible combination of some or all of these features:

- the steel material comprises 0.45-0.50 wt % carbon, inclusive;
- the steel material further comprises boron;
- the steel material comprises 5-30 ppm boron, inclusive;
- the steel material further comprises 0.30-1.00 wt % manganese, inclusive;
- the steel material further comprises 0.001-0.10 wt % titanium, inclusive;
- the steel material further comprises at least one of 0.02-0.06 wt % aluminum, inclusive, or 0.01-0.30 wt % silicon, inclusive;
- the tubular body includes a terminal end, a free end, and a hot lock region located between the terminal end and the free end, wherein an outer diameter ($OD_{Shell}$) of the hot lock region is between 0.40-0.50 inches, inclusive;

- the tubular body includes a terminal end, a free end, and a thread region located between the terminal end and the free end, wherein an outer diameter ($OD_{Shell}$) of the thread region is between 0.30-0.425 inches, inclusive;
- A spark plug, comprising: the spark plug shell of claim 1; an insulator having an axial bore and being disposed at least partially within the axial bore of the spark plug shell; a center electrode being disposed at least partially within the axial bore of the insulator; and a ground electrode being attached to the spark plug shell.

According to another example, there is provided a spark plug shell, comprising: a tubular body of steel material, the tubular body having an axial bore with a longitudinal axis ($L_{Shell}$), wherein the steel material comprises a balance of iron, 0.45-0.50 wt % carbon, 5-30 ppm boron, 0.30-1.00 wt % manganese, 0.001-0.10 wt % titanium, and at least one of 0.02-0.06 wt % aluminum or 0.01-0.30 wt % silicon, where each wt % is inclusive.

According to various embodiments, the spark plug shell may further include any one of the following features or any technically-feasible combination of some or all of these features:

- the tubular body includes a terminal end, a free end, and a hot lock region located between the terminal end and the free end, wherein an outer diameter ($OD_{HL}$) of the hot lock region is between 0.40-0.50 inches, inclusive;
- the tubular body includes a terminal end, a free end, and a thread region located between the terminal end and the free end, wherein an outer diameter ($OD_{Shell}$) of the thread region is between 0.30-0.425 inches, inclusive;
- A spark plug, comprising: the spark plug shell of claim 11; an insulator having an axial bore and being disposed at least partially within the axial bore of the spark plug shell; a center electrode being disposed at least partially within the axial bore of the insulator; and a ground electrode being attached to the spark plug shell.

According to another example, there is provided a method of manufacturing a spark plug shell, comprising the steps of: extruding a tubular body from a steel material, wherein the steel material comprises 0.20-0.55 wt % carbon, inclusive, and the tubular body has an axial bore with a longitudinal axis ($L_{Shell}$); and crimping a hot lock region in the tubular body once an insulator has been inserted into the axial bore, wherein an outer diameter ($OD_{HD}$) of the hot lock region is between 0.40 inches and 0.50 inches, inclusive.

DRAWINGS

Preferred exemplary embodiments will hereinafter be described in conjunction with the appended drawings, wherein like designations denote like elements, and wherein.

DESCRIPTION

The spark plug described herein includes a metal shell made from a steel material having an increased carbon content, and advantageously, with the co-addition of boron.

The steel material for the spark plug shell is well-suited for extrusion because of its ductility, while maintaining requisite strength. The spark plug shell described herein has a reduced outer diameter at a crimped hot lock region. In smaller spark plugs, such as M8 and M10 plugs, as opposed to M12 and M14 plugs, the proportionate diametric reduction at the hot lock region in particular may be more pronounced. The presently described steel material and extruded spark plug shell can help compensate for this diametric reduction at the hot lock region.

Figure 1:
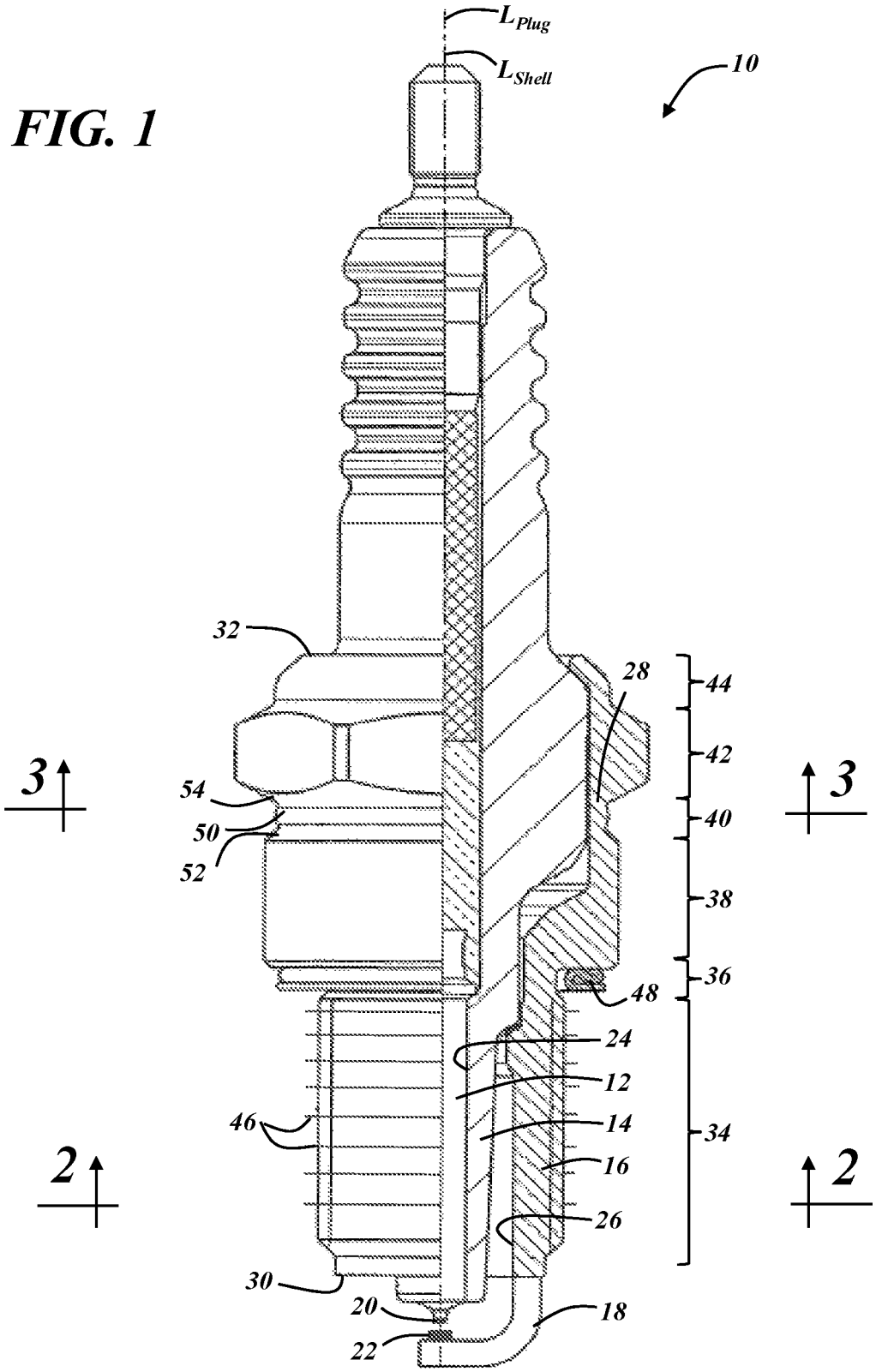
FIG. 1 is a partial cross-sectional view showing an example spark plug having an extruded spark plug shell.

One embodiment of a spark plug is illustrated in FIG. 1, where the shell consists of an advantageous, extruded steel material. In this particular embodiment, the spark plug 10 includes a center electrode 12, an insulator 14, a metal shell 16, and a ground electrode 18. Other spark plug components can include a terminal stud, an internal resistor, various gaskets, internal seals, etc., all of which are known to those skilled in the art. The center electrode 12 is an electrically conductive component and is generally disposed within an axial bore 24 of the insulator 14, and has an end portion that may be exposed outside of the insulator near a firing end of the spark plug 10. The insulator 14 is generally disposed within an axial bore 26 of the shell 16, and may have an end nose portion exposed outside of the shell near the firing end of the spark plug 10. The insulator 14 is preferably made of an insulating material, such as a ceramic composition, that electrically isolates the center electrode 12 from the metal shell 16. Firing tips 20, 22 may be respectively attached to the center and/or ground electrodes 12, 18 depending on the desired spark plug design, and may help form a spark gap where a spark initiates the combustion process during engine operation. Firing tips 20, 22 may include any number of suitable precious metal alloys (e.g., alloys that are iridium-, platinum-, ruthenium-based, etc.), may be single- or multi-piece components, and may be arranged according to any number of suitable shapes (e.g., flat pad, disk, rivet, columnar tip, cone, etc.). Firing tips 20 and/or 22 are optional, however, as the spark gap could be defined by sparking surfaces from the center electrode 12, the ground electrode 18 or both. The electrodes 12, 18 and their associated firing tips 20, 22 may have the common J-gap configuration as shown, or they may have some other configuration, including multiple ground electrodes or ring-shaped electrodes and firing tips, just to cite a few examples. It is even possible for the spark plug 10 to be a pre-chamber type spark plug, where the spark gap is surrounded by a pre-chamber cap that has openings for communication with the combustion chamber of the engine.

The center electrode 12 and/or the ground electrode 18 may include a nickel-based external cladding layer and a copper-based internal heat conducting core. Some non-limiting examples of nickel-based materials that may be used with the center electrode 12 and/or the ground electrode 18 include alloys composed of nickel (Ni), chromium (Cr), iron (Fe), aluminum (Al), manganese (Mn), silicon (Si), and any suitable alloy or combination thereof (e.g., Inconel 600, 601). The internal heat conducting core may be made of pure copper, copper-based alloys, or some other material with suitable thermal conductivity. Of course, other materials are certainly possible, including center and/or ground electrodes that have more than one internal heat conducting core or no internal heat conducting core at all.

The spark plug shell 16 provides an outer structure for the spark plug 10. The shell 16 includes a main tubular body 28 that axially extends between a free end 30 and a terminal end 32. The tubular body 28 includes axial bore 26 which may include various steps, seats, etc. for accommodating the insulator 14, and has a longitudinal axis $L_{shell}$ that generally corresponds to the longitudinal axis of the spark plug $L_{plug}$. In an advantageous embodiment, the shell 16 is extruded with the various features such as steps, threads, etc. machined into the extruded body 28. However, in some embodiments, the body 28 of the shell 16 may be entirely machined. The shell 16 may also include other features not shown in the drawings, such as a nickel-based or zinc-based coating or cladding layer, to cite a few examples. The tubular body 28 of the shell 16 includes a number of regions along the axial extent of shell 16 between the free end 30 and the terminal end 32: a thread region 34, a seal region 36, a seat region 38, a hot lock region 40, a hex region 42, and a crimp region 44.

The thread region 34 is designed to be installed into an engine so that the firing end extends into a combustion chamber. The thread region 34 may include a plurality of threads 46 (only a few of which are labeled in FIG. 1). The threads 46 can be screwed into the cylinder head to provide for mechanical retention of the spark plug, as well as electrical grounding with the engine. The thread region 34 generally corresponds to the axial portion of the spark plug shell 16 that is situated within the cylinder head. The seal region 36 may include a gasket 48, or in some embodiments, may have a tapered configuration or the like, with or without a separate gasket. The seal region 36 engages a complementary shoulder or other sealing surface in the engine and, according to the illustrated embodiment, compresses the gasket 48 therebetween to create a seal between the spark plug and the engine. The hot lock region 40 is located between the seat region 38 and the hex region 42 and creates a seal between an outer surface of the insulator 14 and an inner surface of the shell 16. The hot lock region 40 includes a hot lock groove 50 that is generally defined between radially inward extending walls 52, 54. The hot lock region 40 can be produced in a hot lock crimping process that establishes a structurally sound assembly for retaining the insulator 14 in a gas-tight manner to help prevent leakage of combustion gases during use.

Figure 2:
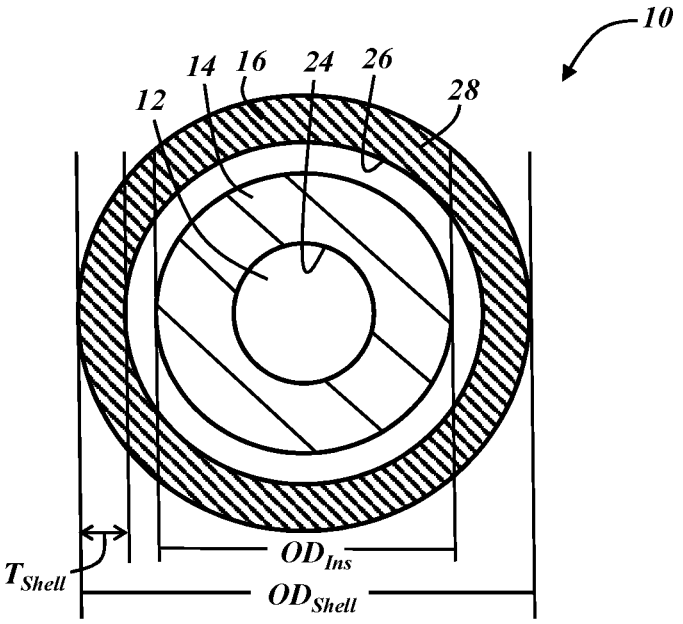
FIG. 2 is another cross-sectional view of the spark plug of FIG. 1, taken along line 2-2 in FIG. 1.
Figure 3:
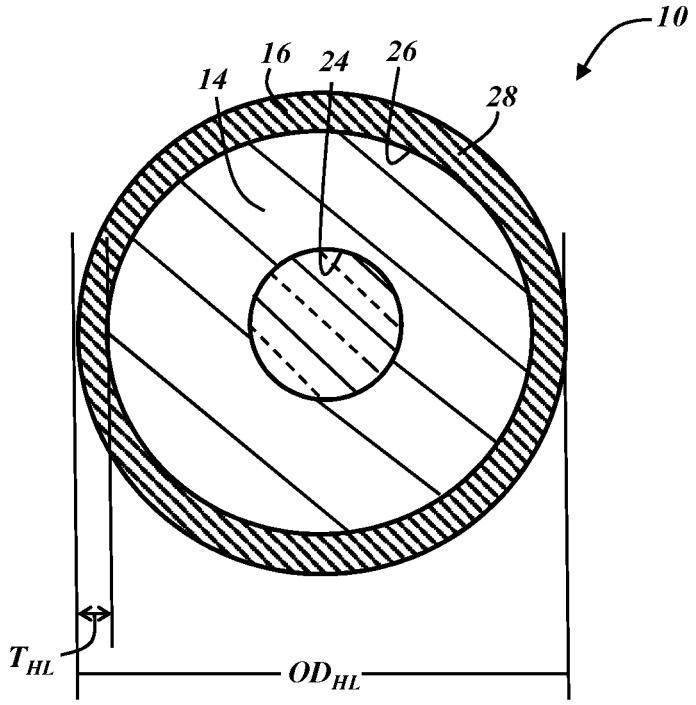
FIG. 3 is another cross-sectional view of the spark plug of FIGS. 1 and 2, taken along line 3-3 in FIG. 1.

FIG. 2 is a cross-sectional view of the thread region 34 taken along line 2-2 in FIG. 1, and FIG. 3 is a cross-sectional view of the hot lock region 40 taken along line 3-3 in FIG. 1. In an advantageous embodiment, the spark plug 10 is a M10 plug, an M8 plug, or even an M6 or smaller plug. Accordingly, at the thread region 34 as shown in FIG. 2, the outer diameter of the shell $OD_{Shell}$ is approximately 0.405 inches (e.g., M10) or 0.350 inches (e.g., M8). These are much smaller than more standard M12 plugs, which are about 0.485 inches. With a smaller $OD_{Shell}$, the insulator diameter $OD_{Ins}$ must accordingly be smaller. For M12 plugs, the $OD_{Ins}$ is approximately 0.37 inches, but for M10 and M8 plugs, the $OD_{Ins}$ is approximately 0.296 inches and 0.25 inches, respectively. To maintain a requisite level of dielectric capability, it may be desirable to decrease the thickness of the shell $T_{Shell}$ to accommodate a larger or thicker insulator 14. Thus, for M12 plugs, the $T_{Shell}$ is approximately 0.0575 inches, but for M10 and M8 plugs, the $T_{Shell}$ is approximately 0.0545 inches and 0.05 inches, respectively.

FIG. 3 and the table below illustrate that the impact of the diametric reduction of the shell 16 can be more pronounced at the hot lock region 40 than in the thread region 34, discussed above.

TABLE I

| Plug size | $OD_{Ins}$ (inches) | $OD_{Shell}$ (inches) | $T_{Shell}$ (inches) | $OD_{HL}$ (inches) | $T_{HL}$ (inches) |
|---|---|---|---|---|---|
| M12 | 0.370 | 0.485 | 0.0575 | 0.557 | 0.0285 |
| M10 | 0.296 | 0.405 | 0.0545 | 0.494 | 0.028 |
| M8 | 0.250 | 0.350 | 0.0500 | 0.494 | 0.027 |

As shown, the $OD_{Shell}$ at the thread region 34 decreases from about 0.485" to about 0.350" from the M12 to the M8 plug. In additional the $T_{Shell}$ at the thread region 34 also decreases from about 0.0575" to about 0.0500" from the M12 to the M8 plug. At the hot lock region 40, although the thickness $T_{HL}$ is about the same between the various plug sizes, the outer diameter $OD_{HL}$ decreases from 0.557" to 0.494" from the M12 to the M8 plug. Advantageously, the spark plug 10 has a thread region outer diameter $OD_{Shell}$ that is between approximately 0.30" and 0.425" inches, inclusive, and a hot lock outer diameter $OD_{HL}$ that is between approximately 0.40" and 0.50", inclusive, for M8 and M10 plugs. The diametric reduction of the $OD_{HL}$ as the plug is downsized can highly increase the local stress level for a given pop up load or twist off torque load applied to the plug 10. To maintain the same (or improve) the twist off capability and/or the pop-up strength, an increase in steel strength of about 20-30% is required. In one embodiment, to transition from the M12 to M8 size in the table above, a 27% increase in steel strength is required.

The steel materials and grain structure of the steel material in the body 28 of the shell 16 can help increase the steel strength and provide better structural reinforcement, particularly in the hot lock region 40 where the proportional diametric reduction is more pronounced. In some advantageous embodiments, the steel material has a higher proportion of carbon than other steels often used for spark plug shells. In other advantageous embodiments, the steel material includes the co-addition of carbon and boron in certain amounts to improve ductility while increasing strength. Additionally, in combination with one or more embodiments described herein, the steel material may have a particular grain structure to help impart force tolerance. The described grain structure may be imparted via particular manufacturing processes, such as extrusion, which is not a feasible process for some steel types that do not have the requisite ductility.

In general, the steel material for the spark plug shell 16 includes an iron (Fe) balance, a carbon (C) content of 0.20 to 0.55 weight percent, and a manganese (Mn) content of 0.30 to 1.00 weight percent (all example ranges described herein are inclusive). In a more advantageous embodiment, the carbon content is 0.45 to 0.50 weight percent, with 0.45 weight percent preferred to achieve the mechanical strength necessary to at least partially counteract the diametric reduction of the hot lock region 40. The manganese can be added to the steel material to de-oxidize the steel melts, and can help form manganese sulphide (MnS) with sulfur to benefit machining while also helping to balance potential brittleness from sulfur. In some embodiments, the steel material for the shell 16 includes no or trace amounts of Nickel (Ni), Chromium (Cr), Vanadium (V), and Molybdenum (Mo).

Advantageously, in some embodiments, the steel material contains boron (B). The boron addition can enhance the strength through hardenability. The amount of boron is preferably 5 to 30 parts per million (ppm). To encourage the mechanical strengthening effect of boron, titanium (Ti) can be added, along with aluminum (Al) or silicon (Si) to fix nitrogen and oxygen in the steel.

In one particular embodiment, the steel material has a balance of iron, a carbon content of 0.20 to 0.55 weight percent, a manganese content of 0.30 to 1.00 weight percent, boron in the range of 5 to 30 ppm, a titanium content of 0.001 to 0.10 weight percent, and either an aluminum content of 0.02 to 0.06 weight percent or a silicon content of 0.01 to 0.30 weight percent. In another particular embodiment, the steel material has a balance of iron, a carbon content of 0.25 to 0.55 weight percent, a manganese content of 0.60 to 0.90 weight percent, boron in the range of 5 to 30 ppm, a titanium content of 0.01 to 0.05 weight percent, and an aluminum content of 0.02 to 0.06 weight percent. In yet another embodiment, the steel material has a balance of iron, a carbon content of 0.40 to 0.50 weight percent, a manganese content of 0.60 to 0.90 weight percent, boron in the range of 5 to 30 ppm, a titanium content of 0.01 to 0.10 weight percent, and an aluminum content of 0.02 to 0.06 weight percent. In all of these embodiments, the carbon content may be advantageously limited to 0.45 to 0.50 weight percent, particularly with the co-addition of 5-30 ppm boron, to help achieve the mechanical strength necessary to at least partially counteract the diametric reduction of the hot lock region 40.

With typical M12 plugs that use 1008/1010 steel, for example, the tensile strength is about 300-350 MPa. The example materials disclosed above have a tensile strength of 450-500 MPa to provide more structural mechanical strength to the diametrically reduced areas of the shell 16, such as the hot lock region 40.

Additionally, in some embodiments, the steel material can be annealed. For annealed materials, the tensile strength is about 450 MPa and the yield strength is about 280 MPa. For unannealed steel, the tensile strength is about 600-700 MPa and the yield strength is about 350-400 MPa. If the shell 16 is to be machined and not manufactured using a deep extrusion process, the steel materials do not need to be annealed to maintain their higher strength. If an extrusion process is used, it may be desirable to anneal the steel material.

Figure 4:
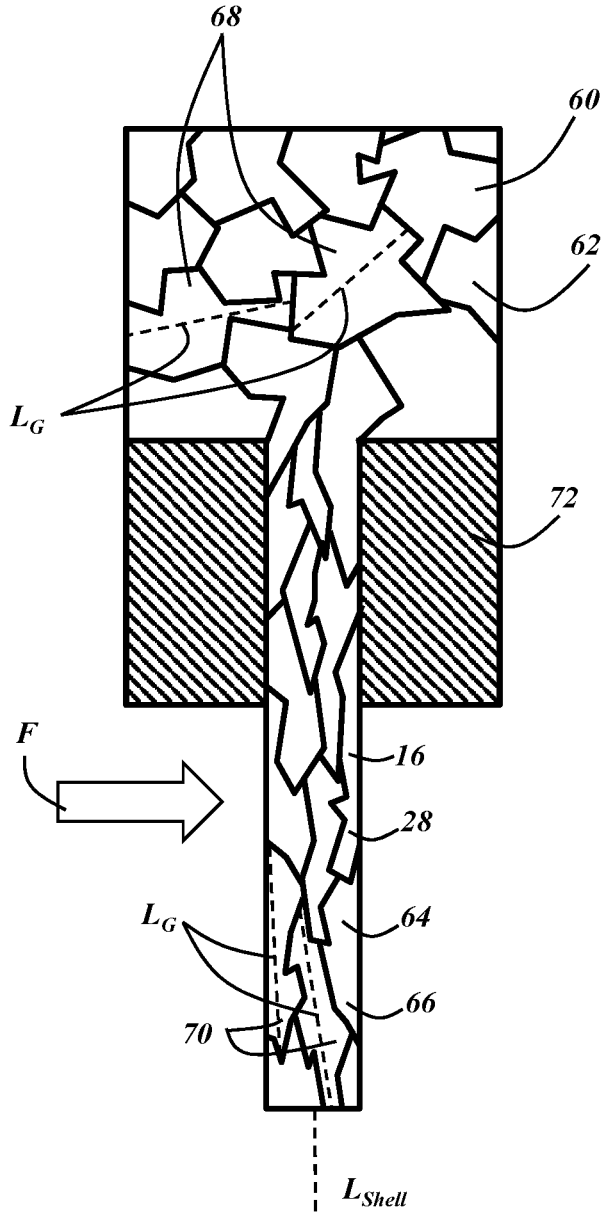
FIG. 4 schematically illustrates an extrusion process that can be used to manufacture a shell for a spark plug, such as the spark plug shown in FIGS. 1-3.

FIG. 4 schematically illustrates an extrusion process that may be used to manufacture the body 28 of the spark plug shell 16. The steel materials described herein have the requisite strength to accommodate the diametrical reduction of various portions such as at the thread region 34 and the hot lock region 40, while still having suitable qualities to accommodate an extrusion process. Extrusion may be advantageous from a manufacturing standpoint, as well as from a structural perspective in the resulting elongated grain structure of the manufactured shell.

As schematically shown in FIG. 4, bulk steel material 60 includes a grain structure 62 and extruded steel material 64 includes a grain structure 66. Each grain structure 62, 66 comprises a plurality of pre-extruded grains 68 or post-extruded grains 70, respectively (only a few are labeled for clarity purposes). Each grain 68, 70 includes a longitudinal axis $L_G$ along a longest extent of each grain, some of which are schematically illustrated in FIG. 4. The extrusion die 72 helps create the elongated grain structure 66, where a majority of the axes $L_G$ for each grain 70 are aligned with the longitudinal axis of the axial bore of the shell 16 ($L_{Shell}$). As used herein, a longitudinal axis of a grain $L_G$ being "aligned" with a longitudinal axis $L_{Shell}$ of the axial bore of the shell means that the grain axis $L_G$ is within +/−15° of being parallel to the shell axial bore axis $L_{Shell}$. The extruded steel material 64, with its elongated grain structure 66 having a majority of the grain axes $L_G$ being aligned with the shell axial bore axis $L_{Shell}$, may be used to form the metal shell 16 of spark plug 10. As shown, the grains 70 in the elongated grain structure 66 have a higher aspect ratio (i.e., the ratio of the longest axis divided by the shortest axis) than the grains in the grain structure 62 of the bulk steel material 60. The elongated grain structure 66 may impart structural benefits, such as when a crimping force F is applied to create the hot lock region. Since the crimping force F is generally orthogonal to a majority of the grain axes $L_G$, the extruded steel material 64 or extrudate may be less prone to stress or breakage.

It is to be understood that the foregoing is a description of one or more preferred example embodiments of the invention, and the figures are examples that are not necessarily to scale. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug shell, comprising:

a tubular body of steel material, the tubular body having an axial bore with a longitudinal axis ($L_{Shell}$), wherein the steel material comprises 0.20-0.55 wt % carbon, inclusive, and includes a grain structure with a plurality of grains, each of the plurality of grains in the grain structure includes a longitudinal axis ($L_G$) along a longest extent of the grain and, for a majority of the plurality of grains in the grain structure, the longitudinal axis ($L_G$) of the grain is aligned with the longitudinal axis ($L_{Shell}$) of the axial bore of the shell, wherein the steel material is extruded to form the grain structure.

2. The spark plug shell of claim 1, wherein the steel material comprises 0.45-0.50 wt % carbon, inclusive.

3. The spark plug of claim 1, wherein the steel material further comprises boron.

4. The spark plug shell of claim 3, wherein the steel material comprises 5-30 ppm boron, inclusive.

5. The spark plug shell of claim 1, wherein the steel material further comprises 0.30-1.00 wt % manganese, inclusive.

6. The spark plug shell of claim 1, wherein the steel material further comprises 0.001-0.10 wt % titanium, inclusive.

7. The spark plug shell of claim 1, wherein the steel material further comprises at least one of 0.02-0.06 wt % aluminum, inclusive, or 0.01-0.30 wt % silicon, inclusive.

8. The spark plug shell of claim 1, wherein the tubular body includes a terminal end, a free end, and a hot lock region located between the terminal end and the free end, wherein an outer diameter ($OD_{HL}$) of the hot lock region is between 0.40-0.50 inches, inclusive, to accommodate a proportionally larger insulator.

9. The spark plug shell of claim 1, wherein the tubular body includes a terminal end, a free end, and a thread region located between the terminal end and the free end, wherein an outer diameter ($OD_{Shell}$) of the thread region is between 0.30-0.425 inches, inclusive.

10. A spark plug, comprising:

the spark plug shell of claim 1;

an insulator having an axial bore and being disposed at least partially within the axial bore of the spark plug shell;

a center electrode being disposed at least partially within the axial bore of the insulator; and a ground electrode being attached to the spark plug shell.

11. The spark plug shell of claim 1, wherein the grain structure extends to areas of the tubular body that are not diametrically reduced in a secondary forming operation.

12. A spark plug shell, comprising:

a tubular body of steel material, the tubular body having an axial bore with a longitudinal axis ($L_{Shell}$), wherein the steel material comprises a balance of iron, 0.45-0.50 wt % carbon, 5-30 ppm boron, 0.30-1.00 wt % manganese, 0.001-0.10 wt % titanium, and at least one of 0.02-0.06 wt % aluminum or 0.01-0.30 wt % silicon, where each wt % is inclusive, wherein the tubular body includes a terminal end, a free end, and a hot lock region located between the terminal end and the free end, wherein an outer diameter ($OD_{HL}$) of the hot lock region is between 0.40-0.50 inches, inclusive, to accommodate a proportionally larger insulator.

13. The spark plug shell of claim 12, wherein the tubular body includes a terminal end, a free end, and a thread region located between the terminal end and the free end, wherein an outer diameter ($OD_{Shell}$) of the thread region is between 0.30-0.425 inches, inclusive.

14. A spark plug, comprising:

the spark plug shell of claim 12;

the proportionally larger insulator having an axial bore and being disposed at least partially within the axial bore of the spark plug shell;

a center electrode being disposed at least partially within the axial bore of the insulator; and a ground electrode being attached to the spark plug shell.

15. A method of manufacturing a spark plug shell, comprising the steps of:

extruding a tubular body from a steel material, wherein the steel material comprises 0.20-0.55 wt % carbon, inclusive, and the tubular body has an axial bore with a longitudinal axis ($L_{Shell}$); and crimping a hot lock region in the tubular body once an insulator has been inserted into the axial bore, wherein an outer diameter ($OD_{HL}$) of the hot lock region is between 0.40 inches and 0.50 inches, inclusive, to accommodate a proportionally larger insulator.

* * * * *